US011298904B1

(12) United States Patent
Gao et al.

(10) Patent No.: US 11,298,904 B1
(45) Date of Patent: Apr. 12, 2022

(54) CAN COMPRESSION EQUIPMENT

(71) Applicant: NINGBO AT-TECHNICAL INTERNATIONAL TRADING CO., LTD, Ningbo (CN)

(72) Inventors: Feng Gao, Ningbo (CN); Xinhui Jiang, Fenghua (CN); Xinguo Fan, Cixi (CN)

(73) Assignee: NINGBO AT-TECHNICAL INTERNATIONAL TRADING CO., LTD, Ningbo (CN)

( * ) Notice: Subject to any disclaimer, the term of this patent is extended or adjusted under 35 U.S.C. 154(b) by 0 days.

(21) Appl. No.: 17/335,654

(22) Filed: Jun. 1, 2021

(30) Foreign Application Priority Data

May 13, 2021 (CN) ..... 202121013838.6

(51) Int. Cl.
*B30B 9/32* (2006.01)
*B30B 1/32* (2006.01)
*B30B 15/30* (2006.01)

(52) U.S. Cl.
CPC ..... *B30B 9/321* (2013.01); *B30B 1/32* (2013.01); *B30B 15/30* (2013.01)

(58) Field of Classification Search
CPC ..... B30B 9/321; B30B 9/32; B30B 1/007; B30B 1/32; B30B 1/323; B30B 1/38; B30B 15/0052; B30B 15/16; B30B 15/168; B30B 15/18; B30B 15/30; Y10S 100/902
See application file for complete search history.

(56) References Cited

U.S. PATENT DOCUMENTS 3,592,217 A * 7/1971 Keagle ..... B02C 19/0081 137/115.14
4,787,308 A * 11/1988 Newsom ..... B30B 9/3007 100/215
5,331,888 A * 7/1994 Brown, Jr. ..... B30B 9/321 100/125
5,839,350 A * 11/1998 Mefferd ..... B09B 3/0058 92/152
7,806,047 B1 * 10/2010 Gomez ..... B30B 9/321 100/216
9,272,842 B1 * 3/2016 Torres-Muniz ..... B30B 9/321
2003/0079620 A1 * 5/2003 Park ..... B65F 1/0033 100/48
2020/0338848 A1 * 10/2020 Hyde ..... B30B 15/166

FOREIGN PATENT DOCUMENTS

DE 3604763 A1 * 9/1986 ..... B23D 31/008
JP 3031171 U * 11/1996 ..... B30B 9/321

* cited by examiner

*Primary Examiner* — Teresa M Ekiert
*Assistant Examiner* — Sarkis A Aktavoukian
(74) *Attorney, Agent, or Firm* — WPAT, PC

(57) ABSTRACT

A can compression equipment is provided and belong to the field of recycling of renewable resources and environmental protection. The can compression equipment includes: a frame; a pressing block arranged at an end of an interior of the frame, an accommodating space being defined between the pressing block and a bottom of the frame and configured for accommodating the can to-be-compressed; and, a driving device connected to the pressing block and configured for driving the pressing block to move forward or backward along a lengthwise direction of the frame to change a size of the accommodating space. Instead of using manpower to compress the can, the can compression equipment can save time and manpower, and further effectively reduce a volume of the can as small as possible.

6 Claims, 6 Drawing Sheets

CAN COMPRESSION EQUIPMENT

FIELD OF THE DISCLOSURE

The disclosure relates to the field of recycling of renewable resources and environmental protection, and more particularly to a can compression equipment.

BACKGROUND OF THE DISCLOSURE

At present, conventional methods of compressing/flattening ring-pull cans (also referred to as easy-open cans, zip-top cans, or pop-top cans) at domestic and abroad basically are to compress the cans by manpower, which are time-consuming and laborious, and cannot effectively reduce a volume of the can as small as possible. Therefore, an improved solution of compressing the cans is needed.

SUMMARY OF THE DISCLOSURE

In the disclosure, a can compression equipment is provided, which aims to solve the technical problems that the conventional methods of compressing cans are time-consuming and laborious, and cannot effectively reduce a volume of the can as small as possible.

The technical problems to be solved by the disclosure may be realized by following technical solutions.

Specifically, a can compression equipment may include a frame, a pressing block and a driving device. The pressing block is arranged at an end of an interior of the frame. An accommodating space is defined between the pressing block and a bottom the frame and configured (i.e., structured and arranged) for accommodating the can to-be-compressed. The driving device is connected to the pressing block and configured for driving the pressing block to move forward or backward along a lengthwise direction of the frame to thereby change a size of the accommodating space.

In an embodiment, the driving device may include a drive cylinder (e.g., pneumatic cylinder, or hydraulic cylinder) and a control valve. The drive cylinder is mounted at an end of the frame, and an end of a piston rod of the drive cylinder is arranged in the interior of the frame and fixedly connected to the pressing block. The control valve is connected to the drive cylinder and configured for controlling the piston rod of the drive cylinder to extend or retract.

In an embodiment, the control valve may include a manual valve or an electric control valve, arranged on an outer wall of the frame. Two gas outlets of the manual valve or the electric control valve are respectively connected to a rod cavity and a rodless cavity of the drive cylinder.

In an embodiment, the can compression equipment may further include an automatic feeding device arranged on an opened end of the frame. The automatic feeding device is configured for placing another can to-be-compressed located outside of the frame into the interior of the frame through the opened end of the frame, when the driving device completes a compression on a can to-be-compressed located in the interior of the frame.

In an embodiment, the automatic feeding device may include a transportation passage and a blocking apparatus. The transportation passage is arranged above the opened end of the frame and configured for accommodating a plurality of cans to-be-compressed arranged juxtaposedly, and an outlet end of the transportation passage is aligned with the opened end of the frame. The blocking apparatus is arranged between the opened end of the frame and the outlet end of the transportation passage, and configured for limiting the number of can to-be-compressed fallen into the interior of the frame to be 1 each time.

In an embodiment, the blocking apparatus may include a pre-extended cylinder and a pre-retracted cylinder oppositely arranged below the transportation passage, and a rod cavity of the pre-extended cylinder and a rodless cavity of the pre-retracted cylinder are both communicated with a rodless cavity of the drive cylinder of the driving device.

In an embodiment, the can compression equipment may further include: an infrared detector and a Microcontroller Unit (MCU) controller. The infrared detector is arranged in the interior of the frame and configured for detecting whether there is a can to-be-compressed in the interior of the frame. The MCU controller is electrically connected to the infrared detector and an electric control valve, and the MCU controller is configured for being signally connected with the electric control valve when the infrared detector detects that the interior of the frame is placed with the can to-be-compressed, or being signally unconnected with the electric control valve when the infrared detector detects that there is no can to-be-compressed in the interior of the frame.

In an embodiment, a through-groove is provided on a side wall of the frame and configured for allowing a can has been compressed to be fallen off.

Compared with the prior art, the embodiments of the disclosure may mainly have the following beneficial effects.

In the disclosure, a can compression equipment as provided may include: a frame; a pressing block arranged at an end of an interior of the frame, an accommodating space being defined between the pressing block and a bottom of the frame and configured for accommodating a can to-be-compressed; and a driving device connected to the pressing block and configured for driving the pressing block to move forward or backward along the lengthwise direction of the frame to thereby change the size of the accommodating space. Instead of using manpower to compress the can, the compression equipment of the disclosure can save time and manpower and further effectively reduce a volume of the can as small as possible.

DESCRIPTION OF REFERENCE SIGNS

1. Frame; 2. Pressing block; 3. Can; 4. Accommodating space; 5. Driving device; 51. Drive cylinder; 511. Rod cavity of the drive cylinder; 512. Rodless cavity of the drive cylinder; 513. Piston rod of the drive cylinder; 52. Control valve; 6. Automatic feeding device; 61. Transportation passage; 62. Blocking apparatus; 621. Pre-extended cylinder; 6211. Rod cavity of the pre-extended cylinder; 6212. Rodless cavity of the pre-extended cylinder; 622. Pre-retracted cylinder; 6221. Rod cavity of the pre-retracted cylinder; 6222. Rodless cavity of the pre-retracted cylinder; 7. Through-groove; 8. Infrared detector; 9. MCU controller; 10. Electric control valve.

DETAILED DESCRIPTION OF EMBODIMENTS

Unless otherwise stated, all technical and scientific terms used herein have same meanings as those commonly understood by those skilled in the technical field of the disclosure. The terms used in the specification of the disclosure are only for the purpose of describing specific embodiments, and are not intended to limit the disclosure. The terms "including" and "having" used in the specification, appended claims and the description of accompanying drawings of the disclosure and any variations thereof are intended to cover non-exclusive inclusions. The terms "first", "second", etc. in the specification and the claims, or the above-mentioned drawings are used to distinguish different objects, rather than to describe a specific order.

The phase "embodiment" mentioned in the disclosure means that a specific feature, structure or characteristic described in conjunction with the embodiment may be included in at least one embodiment of the disclosure. The phrase appeared in various places in the specification does not necessarily refer to the same embodiment, nor is it an independent or alternative embodiment mutually exclusive with other embodiments. Those skilled in the art explicitly and implicitly understand that the embodiments described herein can be combined with other embodiments.

Figure 1:
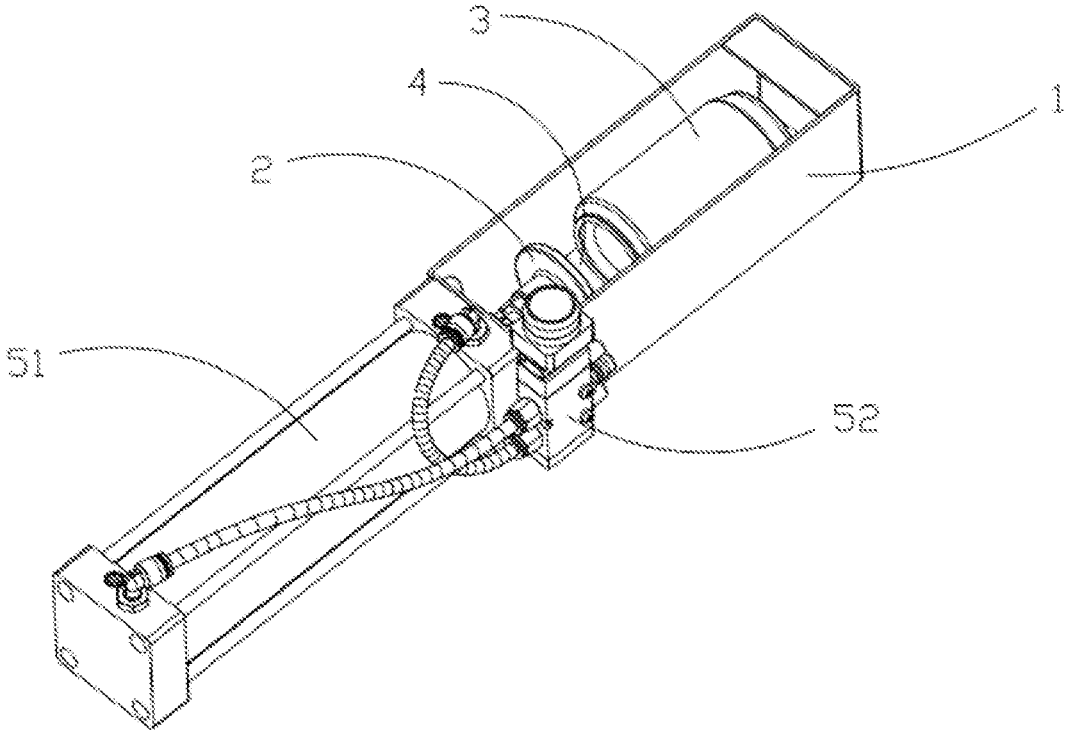
FIG. 1 is a schematic structural view of a can compression equipment of the disclosure.
Figure 2:
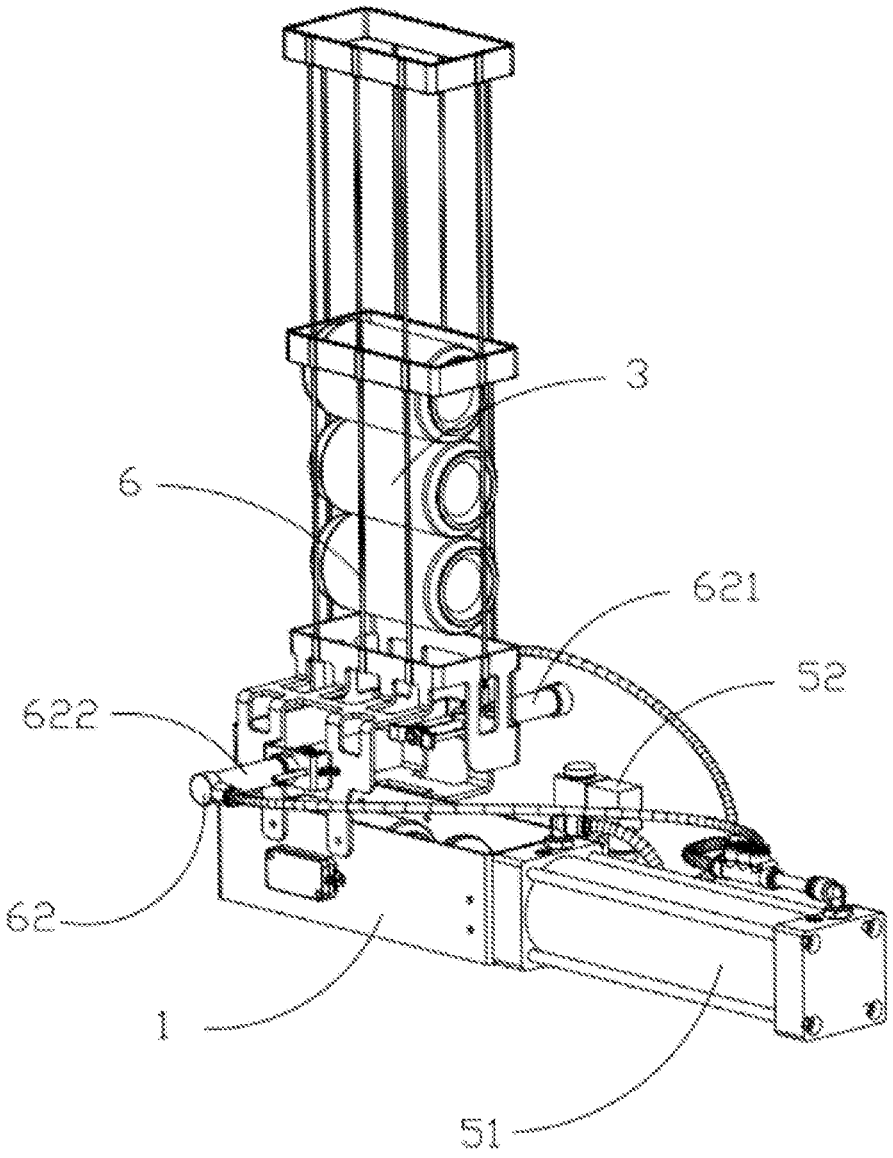
FIG. 2 is a schematic structural view of another can compression equipment of the disclosure.
Figure 3:
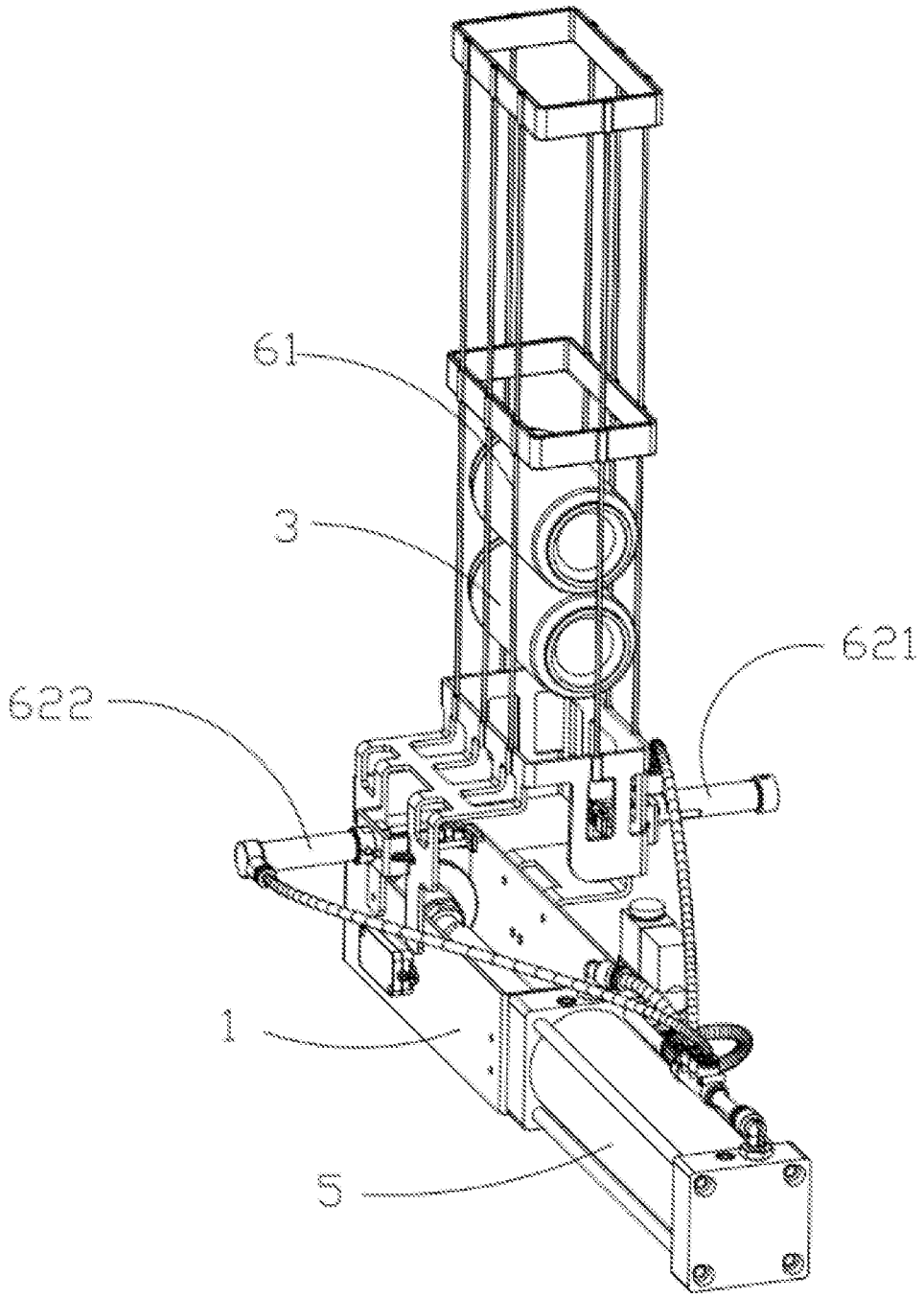
FIG. 3 is a schematic structural view of still another can compression equipment of the disclosure.
Figure 4:
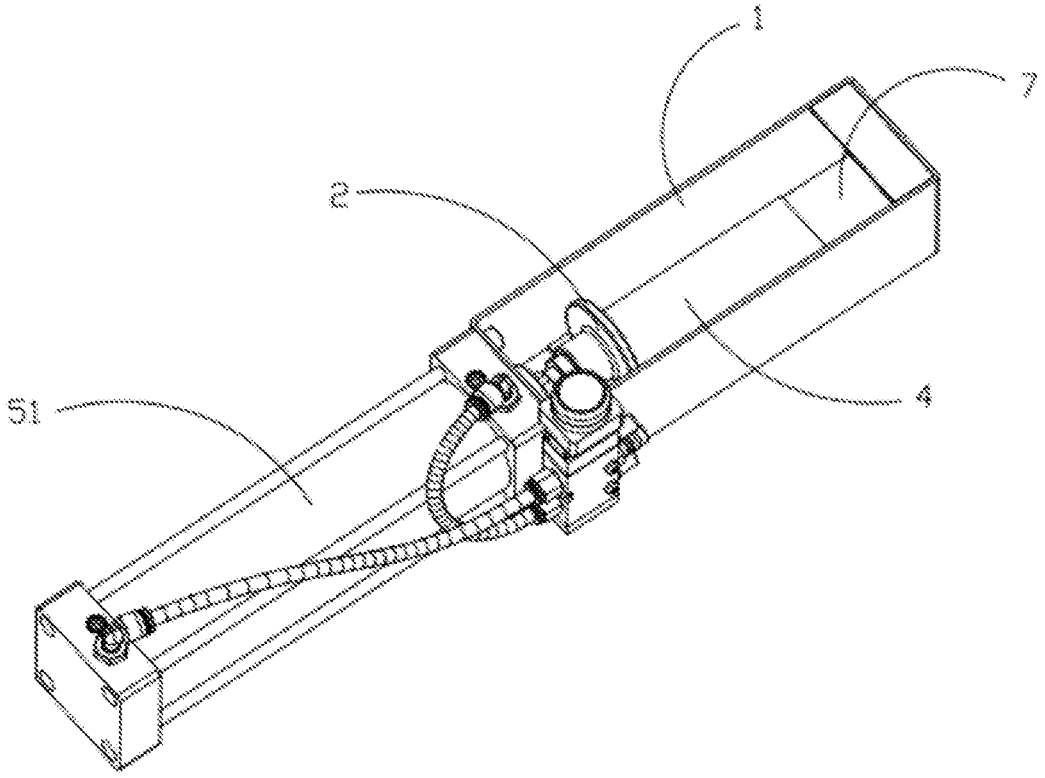
FIG. 4 is a schematic structural view of even still another can compression equipment of the disclosure.
Figure 5A:
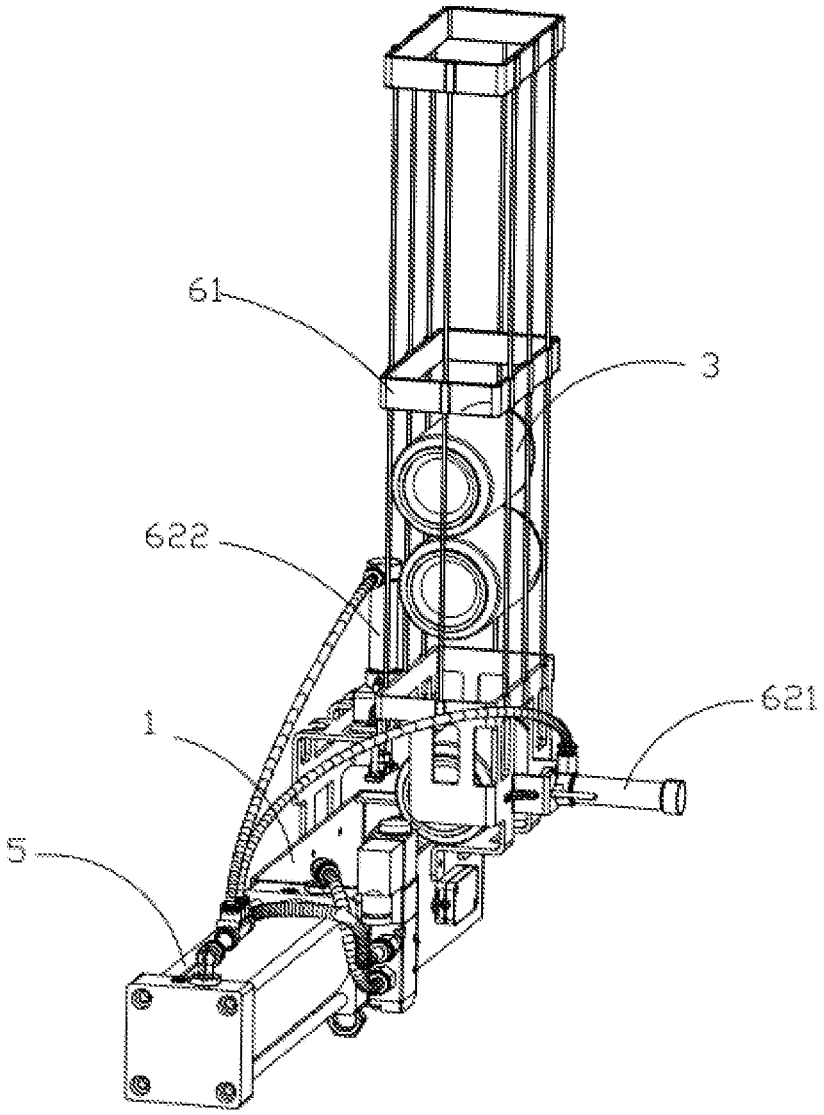
FIG. 5A is a schematic structural view of further still another can compression equipment of the disclosure.
Figure 5B:
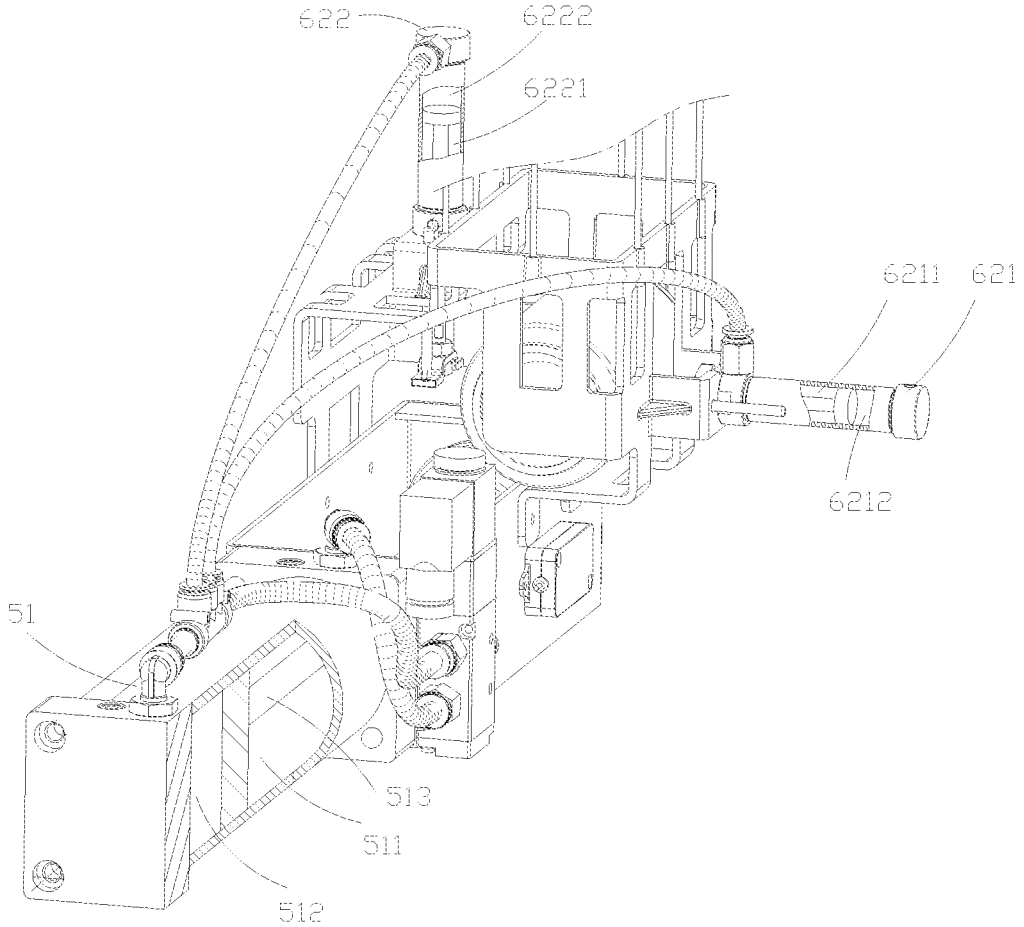
FIG. 5B is a schematic enlarged structural cut-away view of a part of the can compression equipment of FIG. 5A.
Figure 6:
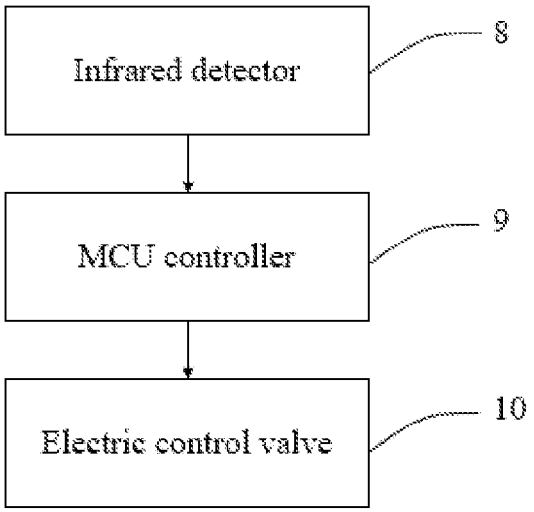
FIG. 6 is a schematic view of showing an infrared detector, a MCU controller and an electric control valve.

Embodiments of the disclosure each provide a compression equipment for a can 3 such as ring-pull can, as shown in FIG. 1 through FIG. 6. The compression equipment (also referred to as can compression equipment) may include: a frame 1, a pressing block 2 and a driving device 5. The pressing block 2 is arranged at an end of an interior of the frame 1. An accommodating space 4 is defined between the pressing block 2 and a bottom of the frame 1 and configured for accommodating the can 3 to-be-compressed. The driving device 5 is connected to the pressing block 2 and configured for driving the pressing block 2 to move forward or backward along a lengthwise direction of the frame 1 to thereby change a size of the accommodating space 4.

In the illustrated embodiment, the compression equipment for the can 3 includes the frame 1, the pressing block 2 and the driving device 5. The accommodating space 4 is defined between the pressing block 2 and the bottom of the frame 1 and configured for accommodating the can 3 to-be-compressed. The pressing block 2 can move forward or backward along the lengthwise direction of the frame 1 under the driving of the driving device 5 connected with the pressing block 2 to thereby change the size of the accommodating space 4, so as to realize the automatic compressing of the can 3 to-be-compressed in the interior of the frame 1. Instead of using manpower to compress the can 3, the compression equipment of the disclosure can save time and manpower, and can effectively reduce a volume of the can as small as possible.

The driving device 5 may include a drive cylinder 51 and a control valve 52. The drive cylinder 51 is mounted at an end of the frame 1, and an end of a piston rod of the drive cylinder 51 is arranged in the interior of the frame 1 and fixedly connected to the pressing block 2. The control valve 52 is connected to the drive cylinder 51 and configured for controlling the piston rod of the drive cylinder 51 to extend or retract, and thereby controlling the pressing block 2 to move forward to compress the can 3 or return back.

The control valve 52 may include a manual valve or an electric control valve, which is arranged on an outer wall of the frame 1. Two gas outlets of the manual valve or the electric control valve are respectively connected to a rod cavity 511 of and a rodless cavity 512 of the drive cylinder 51. A gas inlet of the manual valve or the electric control valve is communicated with a gas source. The piston rod 513 of the drive cylinder 51 can generate a great pressure instantaneously by controlling the manual valve or the electric control valve, and thereby compressing the can 3 pre-placed in the interior of the frame 1. The manual valve is installed on the frame 1, and can be installed on a left side or a right side of the frame 1 according to the user's operating habits. The two gas outlets of the manual valve are respectively provided with silencers/mufflers, and thereby effectively reducing a noise caused by exhaust of the drive cylinder 51.

In a preferred embodiment of the disclosure, as shown in FIG. 1 through FIG. 6, the compression equipment for the can 3 may further include an automatic feeding device 6 arranged on an opened end of the frame 1. The automatic feeding device 6 is configured for placing another can 3 to-be-compressed located outside of the frame 1 into the interior of the frame 1 through the opened end of the frame 1, when the driving device 5 completes a compression on the can 3 to-be-compressed located in the interior of the frame 1.

In an illustrated embodiment, it is available to realize an automatic feeding of the can 3 to-be-compressed instead of the manual feeding, by setting the automatic feeding device 6 on the opened end of the frame 1. The automatic feeding device 6 can place another can 3 to-be-compressed located outside of the frame 1 into the interior of the frame 1 through the opened end of the frame 1, when the driving device 5 completes a compression on the can 3 to-be-compressed located in the interior of the frame 1.

The automatic feeding device 6 may include a transportation passage 61 and a blocking apparatus 62. The transportation passage 61 is arranged above the opened end of the frame 1 and configured for accommodating a plurality of cans 3 to-be-compressed arranged juxtaposedly, and an outlet end of the transportation passage 61 is aligned with the opened end of the frame 1. The blocking apparatus 62 is arranged between the opened end of the frame 1 and the outlet end of the transportation passage 61, and configured for limiting the number of the can 3 to-be-compressed fallen into the frame 1 to be 1 each time.

The blocking apparatus 62 may include a pre-extended cylinder 621 and a pre-retracted cylinder 622. The pre-extended cylinder 621 and the pre-retracted cylinder 622 are oppositely arranged under/below the transportation passage 61. A rod cavity 6211 of the pre-extended cylinder 621 and a rodless cavity 6222 of the pre-retracted cylinder 622 are both communicated with the rodless cavity 512 of the drive cylinder 51 of the driving device 5.

In an embodiment, the pre-extended cylinder 621 and the pre-retracted cylinder 622 can both be horizontally arranged on two sides under the transportation passage 61, so that the pre-extended cylinder 621 and the pre-retracted cylinder 622 can block the falling of the can 3 to-be-compressed by horizontally driving e.g., horizontally extending and retracting; and moreover, the pre-extended cylinder 621 and the pre-retracted cylinder 622 exemplarily are arranged in a manner of up and down. In another embodiment, the pre-extended cylinder 621 can be horizontally arranged on a side of the transportation passage 61 and the pre-retracted cylinder 622 can be vertically arranged on another opposite side of the transportation passage 61, in other words, the pre-extended cylinder 621 and the pre-retracted cylinder 622 are arranged perpendicularly, so that the pre-extended cylinder 621 and the pre-retracted cylinder 622 can block the falling of the can 3 to-be-compressed by horizontally driving (e.g., horizontally extending and retracting) and vertically driving (e.g., vertically extending and retracting) respectively. Because of the horizontal setting of the pre-extended cylinder 621 and the vertical setting of the pre-retracted cylinder 622, an occupied space can be saved, and the can compression equipment is convenient to be installed on the wall. In addition, it is worth noting that, the movements of the pre-extended cylinder 621 and the pre-retracted cylinder 622 are synchronously, e.g., the pre-extended cylinder 621 extends while the pre-retracted cylinder 622 is retracting, whereas the pre-extended cylinder 621 retracts while the pre-retracted cylinder 622 is extending.

When the drive cylinder 51 is not activated, the piston rod of the pre-extended cylinder 621 extends, so that the can 3 to-be-compressed in the transportation passage 61 cannot fall into the interior of the frame 1. Once the drive cylinder 51 is controlled by the manual valve or the electric control valve to extend the piston rod of the drive cylinder 51, the pressing block 2 is driven to compress the can 3 fallen into the interior of the frame 1 in advance. At the same time, the piston rod of the pre-extended cylinder 621 retracts, while the piston rod of the pre-retracted cylinder 622 extends, so that the can 3 to-be-compressed in the transportation passage 61 falls downwardly into a lower layer of the transportation passage 61 due to the gravity, and moreover, due to the blocking of the piston rod of the pre-retracted cylinder 622, the can 3 in the transportation passage 61 cannot continue to fall into the frame 1.

When the piston rod of the drive cylinder 51 is controlled to retract by the manual valve or the electric control valve, the piston rod of the pre-extended cylinder 621 extends, and the piston rod of the pre-retracted cylinder 622 retracts, so that one can 3 to-be-compressed in the transportation passage 61 falls into the frame 1. At the same time, the piston rod of the pre-extended cylinder 621 extends, so that the can 3 to-be-compressed in an upper layer of the transportation passage 61 cannot continue to fall downwardly, thereby ensuring that only one can fall into the frame 1 for the next cycle of compression.

In a preferred embodiment of the disclosure, as shown in FIG. 1 through FIG. 6, the can compression equipment may further include: an infrared detector 8 and a MCU controller 9. The infrared detector 8 is arranged in the interior of the frame 1 and configured for detecting whether there is a can to-be-compressed in the interior of the frame 1. The MCU controller 9 is electrically connected with the infrared detector 8 and the electric control valve 10. The MCU controller 9 is configured for being signally connected with the electric control valve 10 when the infrared detector 8 detects that the interior of the frame 1 is placed with the can 3 to-be-compressed, or being signally unconnected with the electric control valve 10 when the infrared detector 8 detects that there is no can 3 to-be-compressed in the interior of the frame 1.

In an illustrated embodiment, the infrared detector 8 constantly detects whether there is a can 3 in the frame 1. The MCU controller 9 would send a command/signal to the electric control valve 10 (e.g., solenoid valve) to compress the can 3 when the infrared detector 8 detects that there is the can 3 to-be-compressed in the interior of the frame 1, or the can compression equipment stops automatically when the frame 1 is empty and the infrared detector 8 detects that there is no can 3 to-be-compressed in the interior of the frame 1.

In a preferred embodiment of the disclosure, as shown in FIG. 1 through FIG. 6, a through-groove 7 is provided on a side wall of the frame 1 and configured for allowing a can 3 has been compressed to be fallen off.

In an illustrated embodiment, the through-groove 7 is provided on the side wall of the frame 1 and configured for allowing a can 3 has been compressed to be fallen off. The can 3 has been compressed automatically falls off from the through-groove 7 at a front end of the frame 1 when the piston rod of the drive cylinder 51 retracts, and thereby one compression cycle is completed. Of course, more cans 3 can be compressed by repeating the compression cycle.

It should be noted that for the above various embodiments, for the sake of simple description, each are expressed as a combination of a series of actions, but those skilled in the art should be known that the disclosure is not limited by the described sequence of actions, because according to the disclosure, some steps may be performed in other order or simultaneously. Secondly, those skilled in the art should also be known that the embodiments described in the specification are all preferred embodiments, and the actions and modules involved are not necessarily required by the disclosure.

The above embodiments are only used to illustrate technical solutions of the disclosure, but not to limit the protection scope of the disclosure. Apparently, the described embodiments are only some of embodiments of the disclosure, rather than all embodiments of the disclosure. Based on these described embodiments, all other embodiments obtained by those skilled in the art without creative effort fall within the scope of the disclosure. Although the disclosure has been described in detail with reference to the above-mentioned embodiments, those skilled in the art can still combine, add, delete, or make other amendments to the features of the various embodiments of the disclosure according to actual situations without any creative effort, to thereby obtain other different technical solutions without deviating from the inventive concept of the disclosure, and these technical solutions also belong to the protection scope of the disclosure.

What is claimed is:

1. A can compression equipment, comprising:

a frame;

a pressing block arranged at an end of an interior of the frame, wherein an accommodating space is defined between the pressing block and a bottom of the frame and configured for accommodating a can to-be-compressed; and a driving device connected to the pressing block and configured for driving the pressing block to move forward or backward along a lengthwise direction of the frame to thereby change a size of the accommodating space;

wherein the driving device comprises:

a drive cylinder mounted at the end of the frame, and an end of a piston rod of the drive cylinder is arranged in the interior of the frame and fixedly connected to the pressing block; and a control valve connected to the drive cylinder and configured for controlling the piston rod of the drive cylinder to extend or retract;

wherein the can compression equipment further comprises:

an automatic feeding device arranged on an opened end of the frame, wherein the automatic feeding device is configured for placing another can to-be-compressed located outside of the frame into the interior of the frame through the opened end of the frame when the driving device completes a compression on the can to-be-compressed located in the interior of the frame;

wherein the automatic feeding device comprises:

a transportation passage arranged above the opened end of the frame and configured for accommodating a plurality of cans to-be-compressed arranged juxtaposedly, and an outlet end of the transportation passage is aligned with the opened end of the frame; and a blocking apparatus arranged between the opened end of the frame and the outlet end of the transportation passage and configured for limiting number of the plurality of cans to-be-compressed falling into the interior of the frame to be 1 each time;

wherein the blocking apparatus comprises:

a pre-extended cylinder and a pre-retracted cylinder oppositely arranged below the transportation passage, a rod cavity of the pre-extended cylinder and a rodless cavity of the pre-retracted cylinder are both communicated with a rodless cavity of the drive cylinder of the driving device.

2. The can compression equipment according to claim 1, wherein the control valve comprises:

a manual valve or an electric control valve, arranged on an outer wall of the frame, and two gas outlets of the manual valve or the electric control valve are respectively connected to a rod cavity and a rodless cavity of the drive cylinder.

3. The can compression equipment according to claim 1, further comprising:

an infrared detector arranged in the interior of the frame and configured for detecting whether the can to-be-compressed is placed in the interior of the frame; and a Microcontroller Unit (MCU) controller electrically connected to the infrared detector and the control valve, wherein the MCU controller is configured for being signally connected with the control valve when the infrared detector detects the can to-be-compressed is placed in the interior of the frame, or being signally unconnected with the control valve when the infrared detector detects the can to-be-compressed is not placed in the interior of the frame.

4. The can compression equipment according to claim 1, wherein a through-groove is provided on a side wall of the frame and configured for allowing the can to-be-compressed to fall out of the through-groove after the compression of the can to-be-compressed.

5. The can compression equipment according to claim 1, wherein the pre-extended cylinder and the pre-retracted cylinder both are horizontally arranged.

6. The can compression equipment according to claim 1, wherein the pre-extended cylinder is horizontally arranged at a side of the transportation passage, and the pre-retracted cylinder is vertically arranged on an opposite side of the side of the transportation passage.

* * * * *